United States Patent [19]

Andrews

[11] 4,261,513

[45] Apr. 14, 1981

[54] FUEL INJECTION NOZZLES

[75] Inventor: Richard J. Andrews, Guildford, England

[73] Assignee: Lucas Industries Limited, Birmingham, England

[21] Appl. No.: 65,073

[22] Filed: Aug. 9, 1979

[30] Foreign Application Priority Data

Sep. 26, 1978 [GB] United Kingdom ..... 38126/78

[51] Int. Cl.[3] ..... F02M 47/02

[52] U.S. Cl. ..... 239/125; 239/533.8

[58] Field of Search ..... 239/124–127, 239/533.3–533.11; 123/32 JV

[56] References Cited

U.S. PATENT DOCUMENTS 3,797,753 3/1974 Fenne et al. ..... 239/533.8

FOREIGN PATENT DOCUMENTS 879936 6/1953 Fed. Rep. of Germany ..... 239/533.8

*Primary Examiner*—Andres Kashnikow

[57] ABSTRACT

A fuel injection nozzle includes a fuel pressure actuated valve member slidable in a bore and engaged by a piston slidable in a cylinder of smaller diameter than the bore and connected thereto the space defined between the piston and valve member communicates by way of a non-return valve with the end of the cylinder remote from the bore. In operation fuel is displaced from said space past the non-return valve and the pressure in the end of the cylinder remote from the bore rises to increase the force acting to maintain the valve member in the closed position.

8 Claims, 2 Drawing Figures

FUEL INJECTION NOZZLES

This invention relates to a fuel injection nozzle for supplying fuel to a compression ignition engine the nozzle being of the kind comprising a valve member axially movable within a bore, the valve member being shaped for co-operation with a seating to prevent flow of fuel through an outlet orifice from a fuel inlet, the valve member defining a surface against which the fuel pressure at the inlet can act to lift the valve member from the seating against the action of resilient means thereby to permit flow of fuel through the outlet orifice.

Such nozzles are well known in the art and the nozzle opening pressure is determined by the force exerted by the resilient means and the area of said surface exposed to the fuel pressure at the inlet. It is for some engine applications desirable that the nozzle opening pressure should be higher than usual for normal operation of the engine. This however poses problems when starting the engine because of excessive leakage in the injection pump which supplies fuel to the inlet of the injection nozzle. This can make it difficult to start the associated engine because of a low delivery of fuel. Moreover, it is not always possible to achieve the high nozzle opening pressure required because of space considerations which make it difficult to accommodate a resilient means capable of providing the required force.

The object of the present invention is to provide a nozzle of the kind specified in a form in which the nozzle opening pressure is increased after the associated engine has been started.

According to the invention, an injection nozzle of the kind specified comprises a piston housed within a cylinder formed as an extention of the bore, said piston and the cylinder having a smaller diameter than the bore, the piston engaging with the valve member, valve means for controlling the maximum pressure in the end of the cylinder remote from the bore and passage means including a non-return valve through which fuel displaced from the space defined by the valve member, the piston and the walls of the bore and the cylinder, can flow to the end of the cylinder remote from the bore, the arrangement being such that when the engine is at rest the force due to fuel pressure acting on the piston will be substantially zero and as the engine is started the pressure in the end of the cylinder remote from the bore will gradually rise as fuel is supplied thereto from said space, thereby causing an increase in the nozzle opening pressure.

Figure 1:
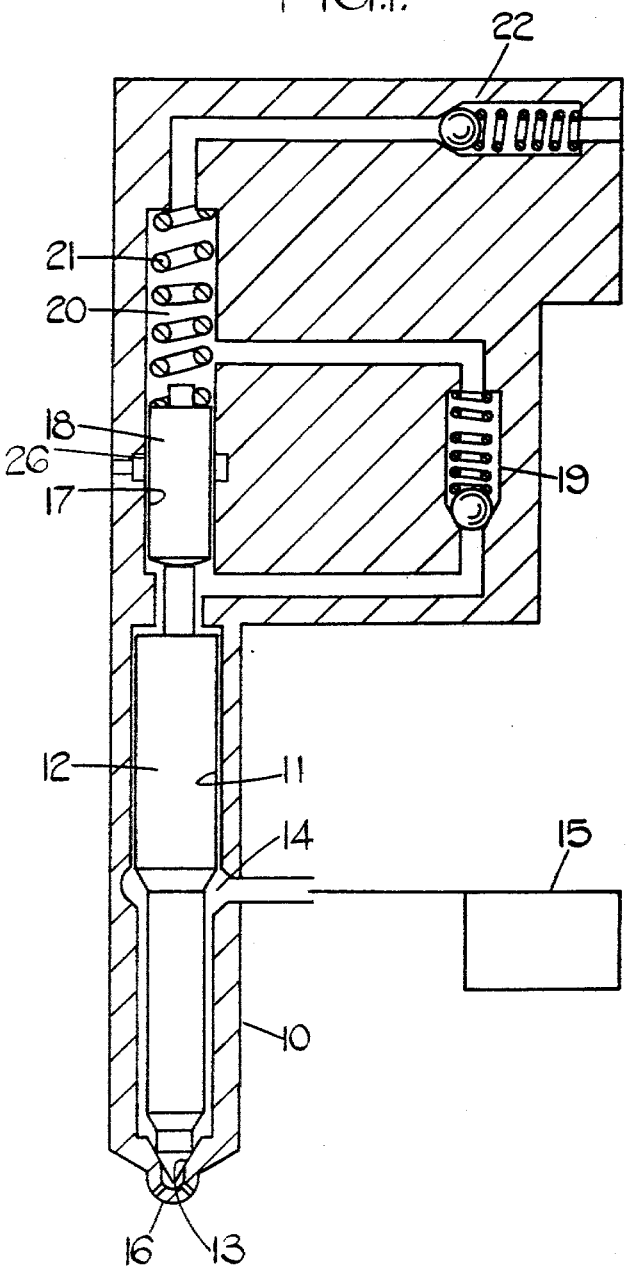
Figure 2:
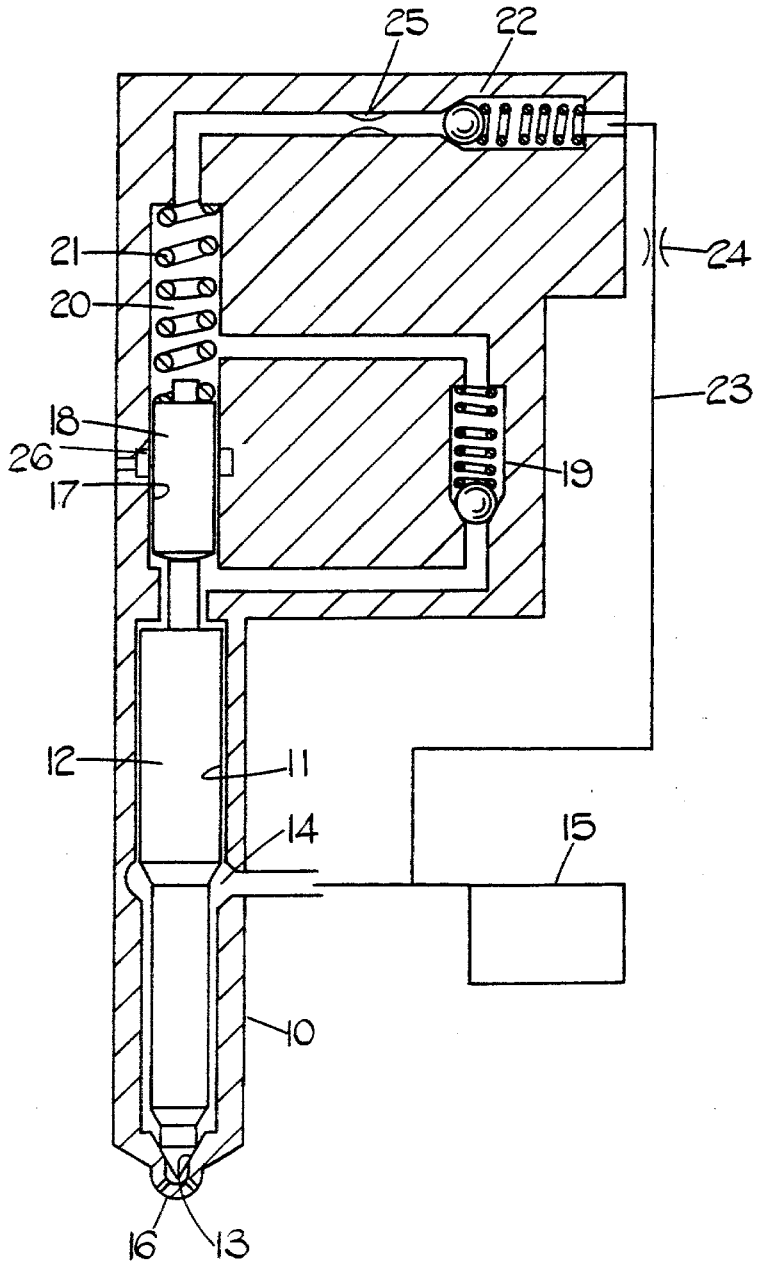

A fuel injection nozzle in accordance with the invention will now be described with reference to the accompanying drawings which are diagrammatic, and in which FIG. 1 shows a preferred embodiment and FIG. 2 shows an alternative embodiment.

Referring to the drawing, the nozzle includes a body portion 10 in which is defined a bore 11 accommodating a valve member 12. The end of the bore 11 defines a seating 13 and a reduced end portion of the valve member is shaped to co-operate with the seating. Moreover, intermediate the ends of the bore there is defined an annular space 14 which communicates with an inlet to which fuel is supplied under pressure by a fuel injection pump 15. The portion of the valve member 12 lying between the space 14 and the seating 13 is of reduced diameter so that surfaces are defined against which the fuel pressure from the injection pump can act to lift the valve member away from the seating 13. Extending from the end of the bore are outlet orifices 16 and when the valve member is lifted from the seating fuel can flow from the injection pump through said orifices into a combustion space of the associated engine.

Also provided is a cylinder 17 which can be regarded as an extension of the bore 11. The cylinder contains a piston 18 which engages with a reduced portion of the valve member. The piston 18 and the cylinder 17 are of lesser diameter than the valve member and bore so that there is defined a space which as the valve member 12 is lifted from its seating, decreases in volume. The fuel flowing from the space passes by way of a non-return valve 19 into a spring chamber 20 defined by the end of the cylinder 17 remote from the bore 11. Within the chamber 20 is a coiled compression spring 21 which acts on the piston 18 to urge same into contact with the valve member 12 and to urge the valve member 12 into contact with the seating 13. The pressure within the spring chamber is vented to drain through a relief valve 22.

In use, when the associated engine is at rest, it can be expected that the fuel pressure within the cylinder, the aforesaid space and the bore 11 will be substantially zero by virtue of leakage. This is to be expected because it is unlikely that the fuel injection pump will be completely free from leakage and therefore the annular groove 14 can be expected to be at low pressure and the pressure in the aforesaid space and the spring chamber 20 will be substantially zero by virtue of leakage between the valve member and the wall of the bore and between the piston 18 and the wall of the cylinder. If however, the injection pump contains a non-return delivery valve then some way of relieving the pressure in the spring chamber 20 and the aforesaid space must be provided and this may take the form of a controlled leakage path in parallel with the relief valve 22 or a controlled leakage path from the aforesaid space. Alternatively, a groove 26 may be formed in the wall of the cylinder 17 and which is covered by the piston 18. The groove is connected to drain and by virtue of the leakage as already described, the pressure in the spring chamber and the aforesaid space will gradually disappear after the engine has been stopped.

When an attempt is made to start the engine the first volume of fuel delivered by the injection pump will generate a pressure which will act upon the surfaces of the valve member 12 in opposition to the force exerted by the spring 21 since there will be substantially no fuel pressure acting upon the piston. As a result the valve member can be lifted from its seating to permit fuel flow through outlet orifices to the engine and the nozzle opening pressure will be determined only by the force exerted by the spring and the area of the aforesaid surfaces. As the valve member is lifted from its seating fuel will be displaced from the aforesaid space and will flow by way of the non-return valve 19 into the spring chamber 20. This flow of fuel will raise the pressure in the spring chamber 20. The volume of fuel in the spring chamber 20 will be retained when the valve moves toward the closed position by the action of the valve 19.

As the piston and valve member move under the action of the spring toward the seating, a cavity will be drawn in the aforesaid space. This process will continue but gradually once the engine has started fuel will leak from the groove 14 into the aforesaid space by way of the running clearance between the valve member 12 and the wall of the bore 11. Such fuel as does find its way into the space will be transformed by way of the non-return valve 19 into the spring chamber and gradually the pressure in the spring chamber will rise. The pressure acting on the piston 18 assists the action of the spring 21 and as a result the nozzle opening pressure will gradually increase. The maximum pressure which can be attained in the chamber 20 is determined by the relief valve 22 and this is set so that the desired maximum nozzle opening pressure is not exceeded. The rate at which the pressure rises depends upon the amount of leakage and also the volume of the spring chamber 20.

It will be appreciated that where a special leakage path is provided, this will have an influence on the rate at which the pressure rises in the spring chamber and therefore the degree of leakage must be carefully arranged so that the desired maximum nozzle opening pressure is achieved within a reasonable time.

In the arrangement described the valve 22 communicates with a drain and hence the pressure in the chamber 20 is determined by the valve 22.

In an alternative arrangement the relief valve 22 can be connected by a passage shown in dotted outline at 23, to the space 14. In this case therefore the pressure in the chamber 20 will depend upon the pressure in the space 14 after the injection of fuel has finished. This pressure depends upon the speed of operation and the amount of fuel which is delivered by the pump and therefore the pressure in the chamber 20 and hence the nozzle opening pressure will vary with speed and fuel delivery. With this arrangement it is desirable to provide at least one flow restrictor upstream or downstream of the valve 22 in order to damp pressure waves in the column of fuel in the flow path between the chamber 20 and the space 14. Preferably flow restrictors 24, 25 are provided on both sides of the valve 22.

I claim:

1. A fuel injection nozzle for supplying fuel to a compression ignition engine and comprising a valve member axially movable within a bore, the valve member being shaped for co-operation with a seating to prevent flow of fuel through an outlet orifice, a piston housed within a cylinder formed as an extension of the bore, a space defined by the valve member, the piston and the walls of the bore and the cylinder, said piston and the cylinder having a smaller diameter than the bore, the piston engaging with the valve member, valve means for controlling the maximum pressure in the end of the cylinder remote from the bore, and passage means including a non-return valve through which fuel displaced from the space defined by the valve member, the piston and the walls of the bore and the cylinder during movement of the valve member away from the seating, can flow to the end of the cylinder remote from the bore, the arrangement being such that when the engine is at rest the force due to fuel pressure acting on the piston will be substantially zero, and as the engine is started the pressure in the end of the cylinder remote from the bore will gradually rise as fuel is supplied thereto from said space, thereby causing an increase in the nozzle opening pressure.

2. A nozzle according to claim 1 in which resilient means comprising a coiled compression spring acts upon said piston.

3. A nozzle according to claim 1 including means defining a leakage path whereby the pressure in said space and the end of the cylinder remote from said bore will be allowed to fall when the associated engine has been stopped.

4. A fuel injection nozzle for supplying fuel to a compression ignition engine and comprising a valve member axially movable within a bore, the valve member being shaped for co-operation with a seating to prevent flow of fuel through an outlet orifice, a piston housed within a cylinder formed as an extension of the bore, a space defined by the valve member, the piston and the walls of the bore and the cylinder, fuel being supplied to said space along the working clearance defined between the valve member and the wall of the bore, said piston and the cylinder having a smaller diameter than the bore, the piston engaging with the valve member, valve means for controlling the maximum pressure in the end of the cylinder remote from the bore, and passage means including a non-return valve through which fuel displaced from the space defined by the valve member, the piston and the walls of the bore and the cylinder, can flow to the end of the cylinder remote from the bore, the arrangement being such that when the engine is at rest the force due to fuel pressure acting on the piston will be substantially zero, and as the engine is started the pressure in the end of the cylinder remote from the bore will gradually rise as fuel is supplied thereto from said space, thereby causing an increase in the nozzle opening pressure.

5. A nozzle according to claim 4 in which said valve means communicates with a drain.

6. A nozzle according to claim 4 in which said valve means communicates with said fuel inlet.

7. A nozzle according to claim 6 including a flow restrictor in the flow path between the cylinder and the fuel inlet, said flow restrictor acting to damp pressure waves in the column of fuel in the flow path.

8. A nozzle according to claim 6 including flow restrictors positioned on opposite sides of said valve means.

* * * * *